US006920985B2

(12) United States Patent
Chandaria

(10) Patent No.: US 6,920,985 B2
(45) Date of Patent: Jul. 26, 2005

(54) DISPLAY SYSTEM FOR WRAPPING PAPER AND ADHESIVE TAPE

(76) Inventor: Ashok V. Chandaria, P.O. Box 48020, Nairobi (KE)

( * ) Notice: Subject to any disclaimer, the term of this patent is extended or adjusted under 35 U.S.C. 154(b) by 86 days.

(21) Appl. No.: 10/410,388

(22) Filed: Apr. 8, 2003

(65) Prior Publication Data

US 2004/0200787 A1 Oct. 14, 2004

(51) Int. Cl.[7] ..... A47F 7/00
(52) U.S. Cl. ..... 211/13.1; 211/59.1; 211/194
(58) Field of Search ..... 211/13.1, 59.1, 211/194, 189, 90; 248/222.3

(56) References Cited

U.S. PATENT DOCUMENTS

| | | | | | |
|---|---|---|---|---|---|
| 3,231,097 | A | * | 1/1966 | Hodson | 248/220.42 |
| 3,258,870 | A | * | 7/1966 | Offenhauer | 40/622 |
| 3,295,285 | A | * | 1/1967 | Metz | 52/514 |
| 3,462,012 | A | * | 8/1969 | Fineman et al. | 206/459.1 |
| 4,531,313 | A | * | 7/1985 | Fast | 40/657 |
| 4,779,367 | A | * | 10/1988 | Fast | 40/657 |
| 4,951,827 | A | * | 8/1990 | Moransais | 211/59.1 |
| 5,593,219 | A | * | 1/1997 | Ho | 312/263 |
| 2002/0114909 | A1 | * | 8/2002 | Aiello | 428/40.1 |
| 2004/0067342 | A1 | * | 4/2004 | Shepard et al. | 428/182 |
| 2004/0211735 | A1 | * | 10/2004 | Chandaria | 211/13.1 |

FOREIGN PATENT DOCUMENTS

| | | | | |
|---|---|---|---|---|
| FR | 2678970 | * | 1/1993 | 211/13.1 X |
| FR | 2734138 | * | 11/1996 | 211/13.1 X |

* cited by examiner

*Primary Examiner*—Bruce A. Lev
(74) *Attorney, Agent, or Firm*—Sand & Sebolt

(57) ABSTRACT

A display system includes the combination of an free-standing cardboard box and a display board adapted to display retail products in such a manner that product is displayed for the consumer without taking up shelf space. The box has a rectangular bottom wall and four upstanding walls defining an upwardly open interior chamber for displaying elongate products such as rolls of wrapping paper. The box may be a portion of the shipping box that which the rolls were shipped in to the retailer. The display board is adapted to hang from an upper rim of the box using a pair of S-hooks which extend through holes adjacent an upper edge of the display board and over the upper rim. The display board includes a plurality of adhesive strips for releasably securing complementary products thereto for display with the elongate products in the box, such as adhesive tape dispensers for use with the wrapping paper. The adhesive strips allow the complementary products to be removed from the display board for inspection by consumers, and if no purchase is made the product may be reattached to the display board.

10 Claims, 12 Drawing Sheets

DISPLAY SYSTEM FOR WRAPPING PAPER AND ADHESIVE TAPE

BACKGROUND OF THE INVENTION

1. Technical Field

The invention relates generally to display systems for off-shelf displaying of products in retail stores. More particularly, the invention relates to display systems which may utilize the shipping box in which retail products are transported to retailers as part of the display system. Specifically, the invention relates to a display system utilizing the lower half of a shipping box to support having elongated retail products contained therein such as wrapping paper, and a display board which hangs from an upper rim of the shipping box to display complementary retail products such as adhesive tape.

2. Background Information

The typical retail store groups related products on shelves or on hanger rods which mount to a wall or other upright structure and which extend inwardly toward the isles of the store. The shelves typically hold boxed products and other such items which are readily supported on the flat upper surface of the shelves. The depth of most shelves is limited such that elongate products do not conveniently fit and must be positioned parallel to the isle taking up an unacceptably wide shelf area in most stores. Hanger rods are typically used to display products such as those packaged in lightweight cardboard or flexible plastic packages which may be hung from the hanger rod by a hole through an upper end of the packaging. Such packaged products which are too small to place on the shelves or which are seasonal in nature are frequently hung from elongate clip strips made of a light weight flexible plastic strip about one inch wide and from about twenty to forty inches in length. These clip strips are typically die-cut to produce a plurality of upwardly extending single flaps disposed lengthwise along the clip strip. Each single flap is flanked by a pair of downwardly extending flaps to form a flap group to retain the products. The products are mounted to the clip strip by positioning the upper end of the cardboard backing sheet under the pair of flaps and inserting the single flap through the hanging hole of the backing sheet to support the product. The flap group retains the backing sheet on the clip sheet while permitting a backing sheet with packaged product to be easily removed from the clip strip by pulling the product away from the clip strip to deflect the flaps. The top of the clip strips typically include a hole to wire them to shelf supports and product displays in locations around the store where consumers might be enticed to buy the products displayed on the clip strips. The clip strips allow complementary products such as ball point pens to be displayed adjacent primary products such as packs of writing tablets on shelves without taking up valuable shelf space.

There are a number of drawbacks to the use of clip strips. Firstly, attachment of products to the clip strips is labor-intensive, requiring each individual product to be manually mounted to the flaps of the clip strips at the retail store. If the products come pre-mounted to the clip strips from the manufacturer of the product, the products often disengaged from the flaps of the clip strips during transport to the retailer. The retailer must then manually reattach the products to the clip strips which at least partially defeats the purpose of having the products sent pre-attached to the clip strips. Secondly, only a limited number of the products may be displayed on any one clip strip depending on the number of flap groups present, typically being between about ten and thirty flap groups. Thirdly, when consumers remove the products from the clip strips it is easy to inadvertently disengage the other products from the clip strip. Fourthly, once the flap group has been used to retain and dispense the product, the flaps tend to become weakened and deformed due to the bending involved in engaging and disengaging the product. Therefore, if the product is reattached to the clip strip such as when the consumer decides not to purchase the product, or when new products are attached to the clip strip to replace sold products, the products may inadvertently fall off the clip strip onto the floor. Finally, products displayed on the clip strips typically look unsightly, hanging at various angles from the clip groups rather than neatly aligned. As a result, many retailers are not using clip strips and many chain retailers are banning the use of clip strips in their stores.

Seasonal products such as wrapping paper and adhesive tape typically are shipped to retailers in corrugated cardboard boxes. The wrapping paper is often displayed in a vertical position within the original shipping box with the top half of the box cut off to expose the wrapping paper. The adhesive tape is a product which is complementary to the primary product of wrapping paper since the wrapping paper is typically secured around a package using adhesive tape. The adhesive tape typically comes with a single roll of adhesive tape affixed to a backing sheet having an upper hole for hanging, or in multi-roll adhesive tape packages comprising a cardboard box which partially or completely encloses two or more rolls of adhesive tape. It is desirable to stock the adhesive tape close to the wrapping paper on shelves, either being hung from hanger rods or attached to clip strips adjacent the wrapping paper. However, the small size of carded single rolls of adhesive tape and the multi-roll adhesive tape packages makes them difficult to stock and maintain neatly on shelves. The adhesive tape on shelves falls over, does not stay in straight rows, and may fall onto the floor. Likewise, adhesive tape hung from hangers or clip strips looks untidy, may fall onto the floor, and may not be replaced properly by consumers onto the hanger rod or clip strip if the consumer decides not to make the purchase. It would be desirable to have a single display system for both the wrapping paper and the adhesive tape, and for similar primary products and complementary second products.

BRIEF SUMMARY OF THE INVENTION

Objectives of the invention include providing a display system which effectively displays primary products and complementary products in retail stores while not taking up valuable floor space.

Another objective is to provide a display system which may utilize the shipping box for the primary products as part of the display.

A further objective is to provide a display system to which the complementary products are removably mountable and remountable to permit closer inspection of products by consumers and remounting if the purchase decision is reversed.

A still further objective of the invention is to provide such a display system which is of light weight, sturdy, inexpensive, may be disposable, may be biodegradable, and which solves problems and satisfies needs existing in the art.

These and other advantages and features of the invention are obtained by the improved display system of the present invention for displaying a plurality of primary products and a plurality of complementary products, the general nature of which may be stated as including: a box having a bottom wall adapted to be supported on the floor and an upwardly dependent peripheral wall which terminates at an upper rim, the bottom and peripheral walls which define a product receiving interior chamber adapted to receive the plurality of primary products; a relatively rigid display board having respective front and rear surfaces, the front surface being adapted to removably mount the plurality of complementary products; and at least one retaining device adapted to connect the display board to the peripheral wall in a generally vertical orientation.

The box preferably has a bottom wall of a substantially rectangular shaped and the peripheral wall comprises opposing front and rear walls and a pair of opposing side walls. The display board is preferably made of a sheet of corrugated plastic material having a corrugated core comprised of a plurality of parallel straight or curved ribs sandwiched between respective substantially flat front and rear sheets. An adhesive is preferably applied to the front surface of the display board allows for repeated removal and replacement of the complementary products thereon. The retaining device preferably comprises a pair of S-hooks which have an upper hook to engage the upper rim of the box and a lower hook to engage the display board through a corresponding hanging hole through the display board. The hanging holes are spaced apart adjacent an upper edge of the display board to hang the display board in a vertical orientation from the upper rim of the box. The front surface of the display board faces away from the box to allow display of the primary products and the rear surface faces the box.

The display board may include a second sheet which is bonded to the front surface of the corrugated first sheet. The second sheet has a plurality of complementary product receiving holes therethrough shaped to receive the complementary products therein, the front surface forming respective backing surfaces for the product receiving holes to removably mount the plurality of complementary products. Adhesive applied to the backing surfaces allows for repeated removal and replacement of the complementary products mounted thereon.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numerals refer to similar parts throughout the drawings.

DETAILED DESCRIPTION OF THE INVENTION

Figure 1:
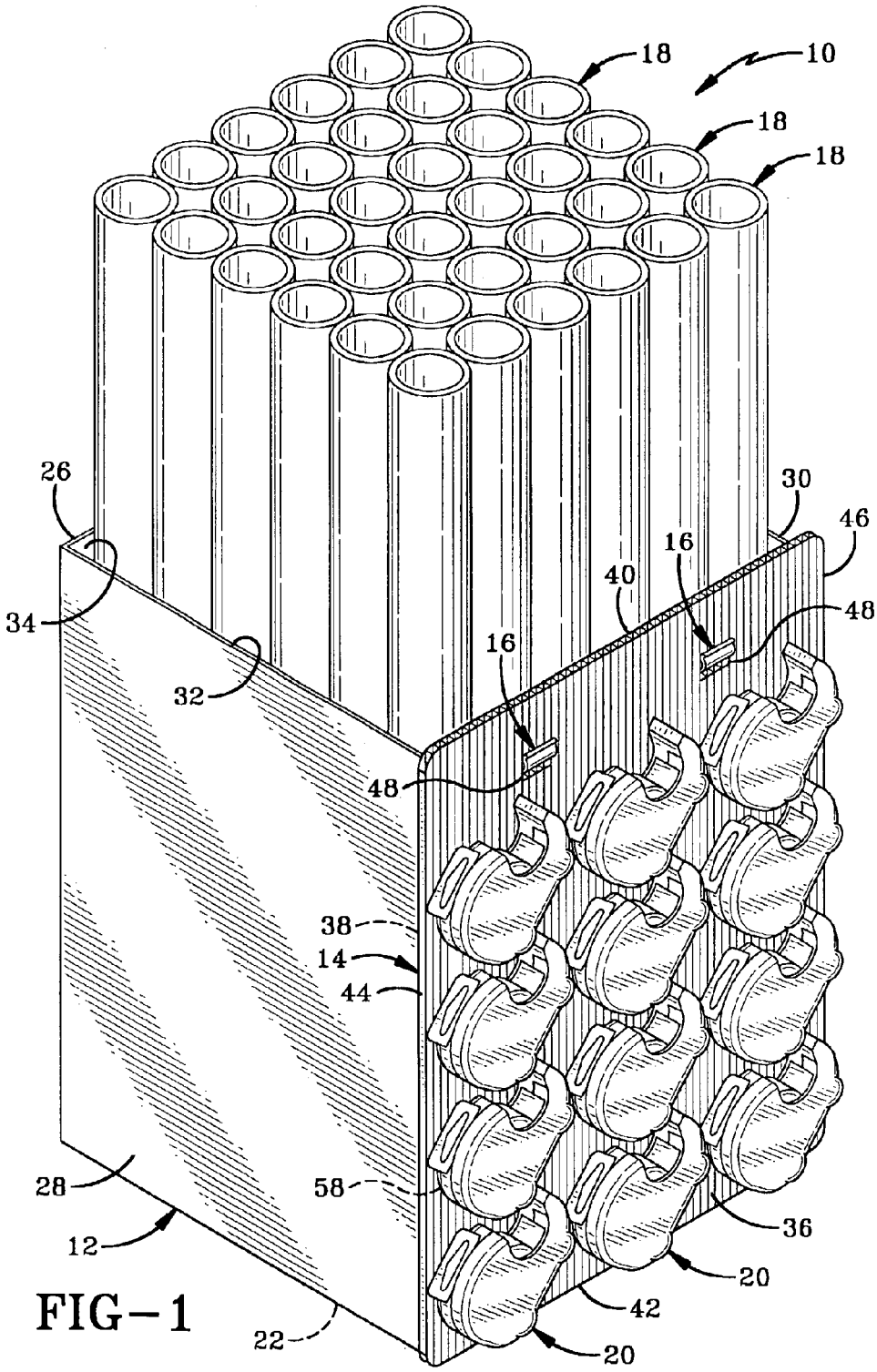
FIG. 1 is a perspective view of the display of the present invention.
Figure 2:
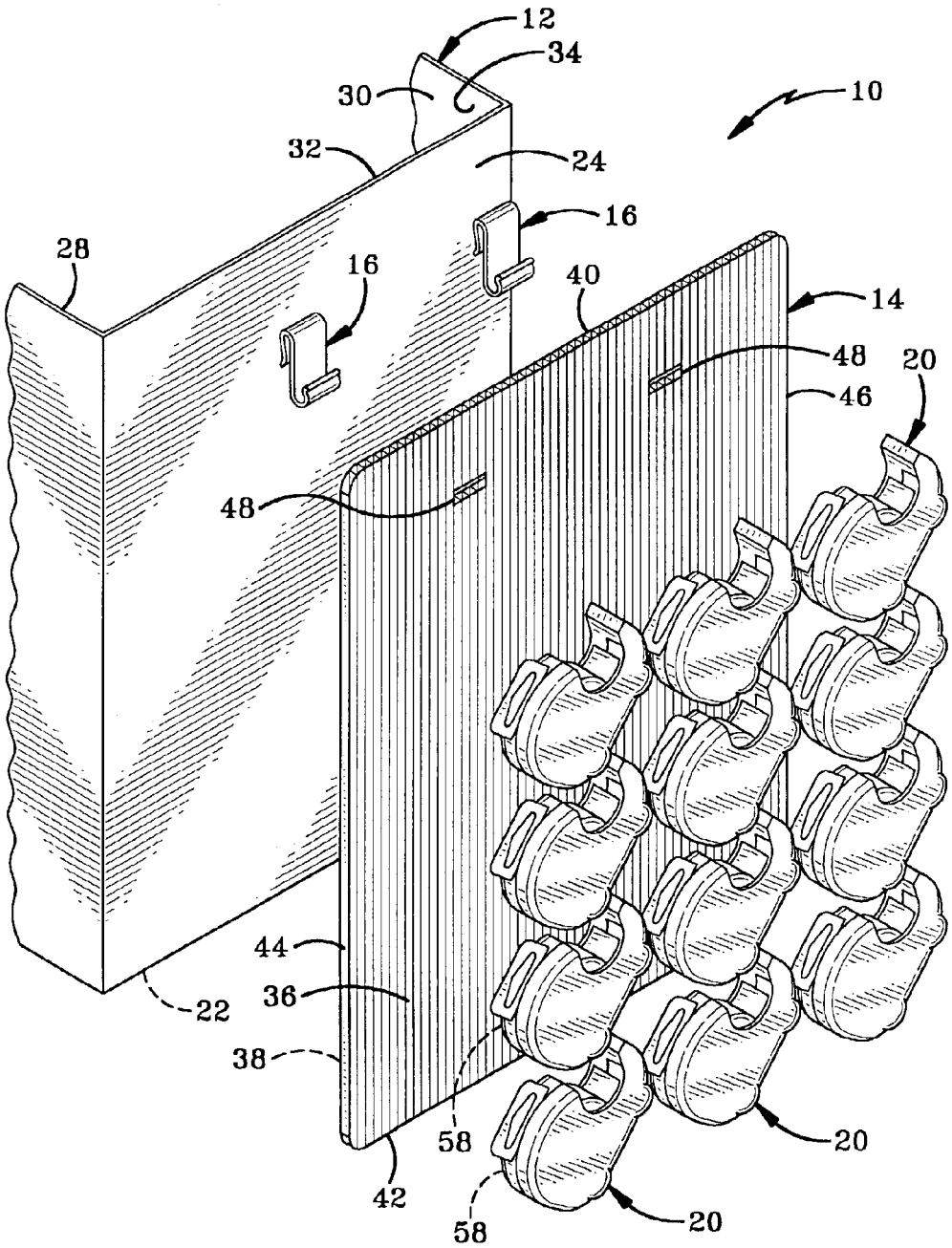
FIG. 2 is an exploded view of the box, display board, and tape dispensers of FIG. 1, the box being shown partially broken away.
Figure 3:
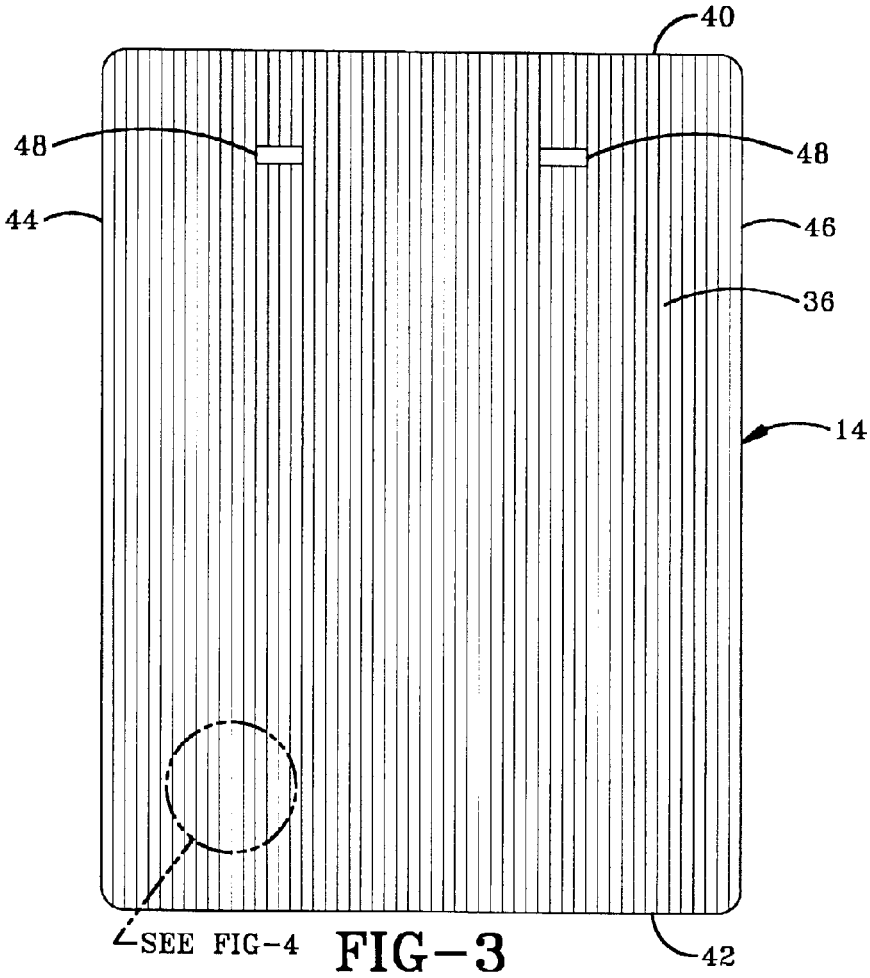
FIG. 3 is a front view of the display board shown in FIG. 1.
Figure 4:
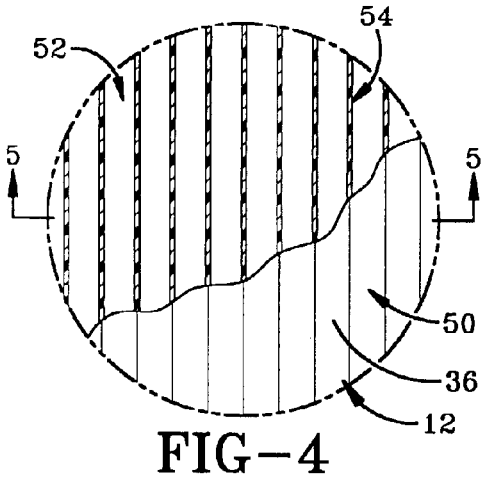
FIG. 4 is an enlarged fragmentary view of the display board taken along line 4—4 of FIG. 3, with a top sheet partially broken away showing a corrugated core comprised of a plurality of straight reinforcement ribs.
Figure 5:
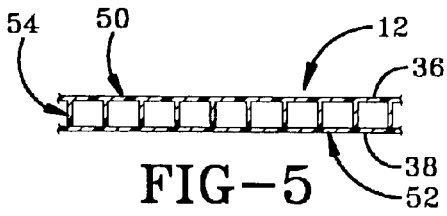
FIG. 5 is a sectional view of the display board taken along line 5—5 of FIG. 4.
Figure 6:
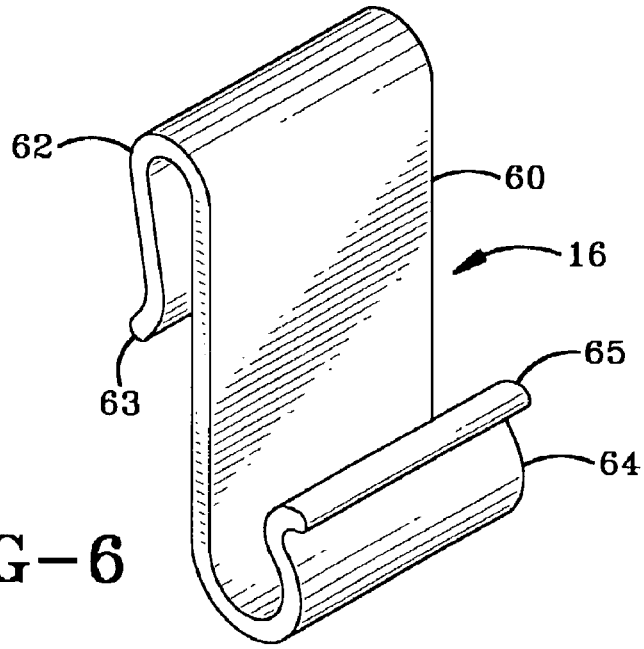
FIG. 6 is an enlarged perspective view of one S-hook.
Figure 7:
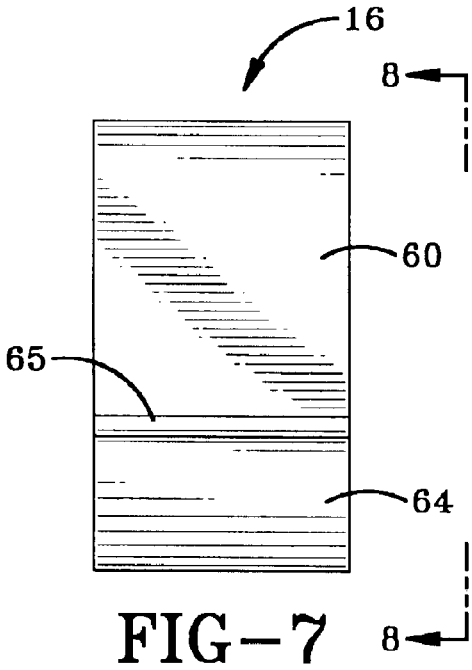
FIG. 7 is a front view of the S-hook shown in FIG. 6.
Figure 8:
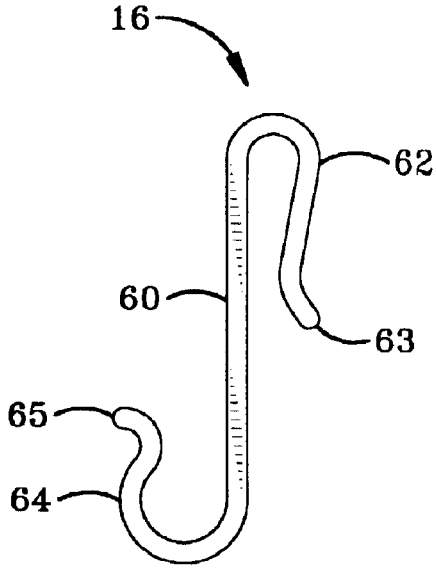
FIG. 8 is a side view of the S-hook taken along line 8—8 of FIG. 7.
Figure 9:
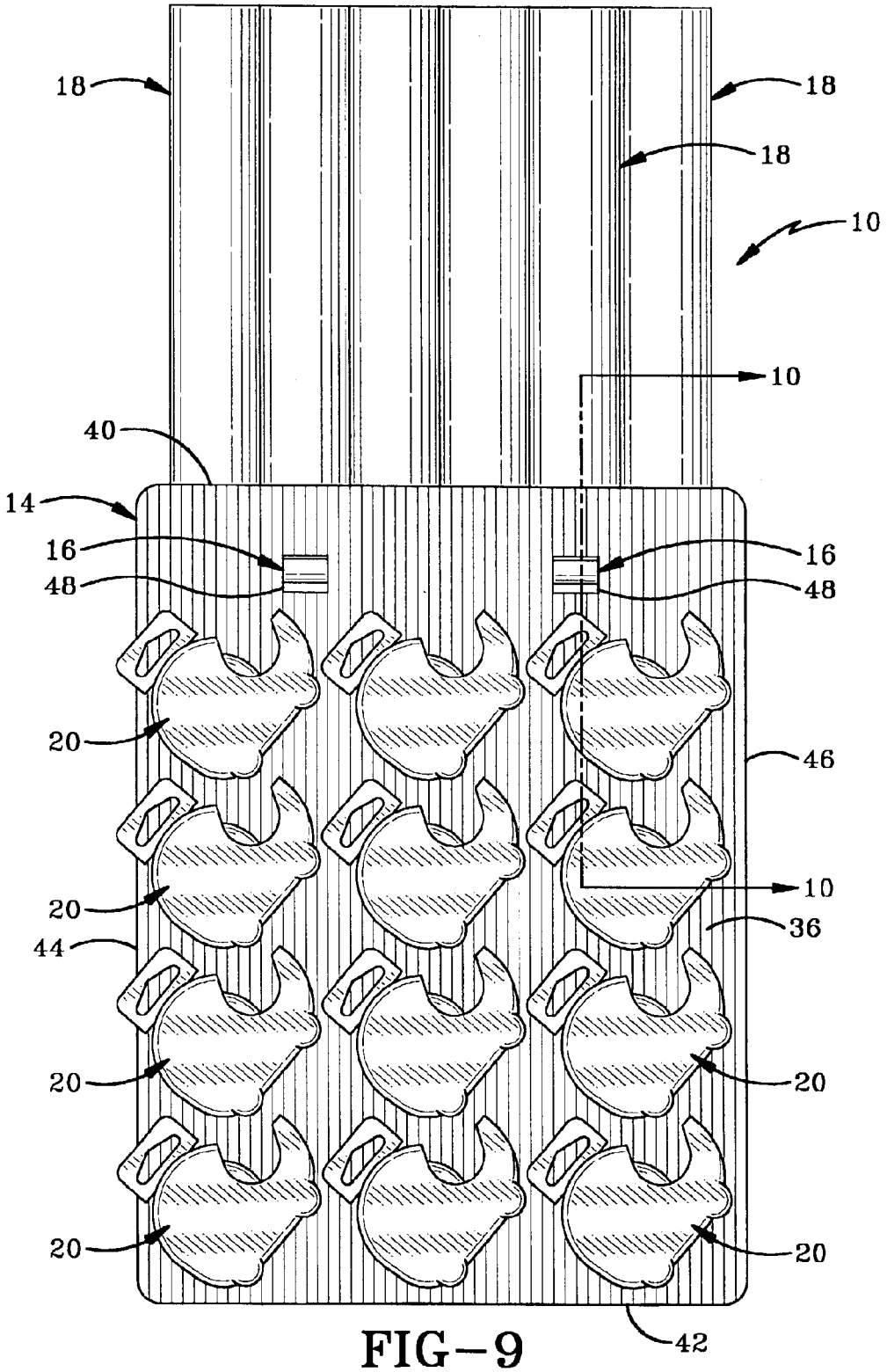
FIG. 9 is a front view of the box, display board, and tape dispensers of FIG. 1.

A first embodiment improved display system of the present invention for use in retail stores for displaying products to consumers is indicated generally at 10, and is shown in FIGS. 1–12. Display system 10 includes a box 12, a relatively rigid display board 14, and a pair of retaining devices in the form of S-hooks 16, shown as used with primary and complementary retail products. For the purposes of illustration, retail products in the form of a plurality of paper rolls 18 of wrapping paper contained in the box 12, and a plurality of single-roll tape dispenser 20 removably mounted on the display board 14 are shown. However, it is understood that the retail products used with this and the following display systems may be other retail products other than paper rolls 18 in the box 12, and the tape dispensers 20 may be other retail products mounted to the display board 14. The paper rolls 18 are the primary product and the tape dispensers 20 are the complementary products thereto.

The box 12 may be part of the original shipping box for the retail products or one specially made for the display system 10, and preferably includes a substantially flat, rectangular bottom wall 22 supported on a floor (not shown), an upwardly dependent peripheral wall comprising respective opposing substantially flat, rectangular front and rear walls 24 and 26; and two opposing substantially flat, rectangular side walls 28 and 30. The peripheral wall terminates at an upper rim 32, with the walls 22, 24, 26, 28, and 30 defining a product receiving interior chamber 34 for receiving the plurality of paper rolls 18. The paper rolls 18 may be shipped to the retailer in box 12 with an upper portion thereof (not shown) completing the enclosure of the paper rolls 18 during shipping. The upper portion is removed by cutting away at the upper rim 32 leaving the box 12 as shown.

Display board 14 includes a front surface 36, a rear surface 38, respective upper and lower edges 40 and 42, and side edges 44 and 46. A pair of spaced hanging holes 48 of an elongate rectangular shape through display board 14 are disposed adjacent upper edge 40 through which the S-hooks 16 may be received as described subsequently for hanging display board 14 for displaying tape dispensers 20. Display board 14 is preferably of corrugated construction, comprising a substantially flat upper sheet 50 and a substantially flat lower sheet 52 interconnected by a straight-ribbed corrugated core 54 comprised of a plurality of parallel straight ribs which is bonded to each. Display board 14 is preferably made of corrugated plastic, though any suitable material such as corrugated cardboard, paperboard, sheet plastic, and the like possessing sufficient thickness and strength to hang on the box 12 and support the weight of the retail products such as the tape dispensers 20 may be used. The display board 14, as well as those which follow, may be made in different colors and may have printed indicia such as product descriptions, logos, and the like to enhance the aesthetic appeal. Likewise, box 12 may be specially made from corrugated cardboard or plastic in matching colors with indicia rather than the original box in which the paper rolls 18 were shipped to the retailer. S-hooks 16 may also be molded in different colors to match the box 12 and display board 14.

The tape dispensers 20 are removably mounted to the upper surface 36 of display board 14 using a plurality of adhesive areas (not shown) such as a liquid adhesive which partially dries to allow mounting and remounting or adhesive strips such as double-sided adhesive tape which adheres a rear surface 58 of the tape dispensers 20 to the display board 14. The adhesive areas allow for repeated removal and replacement of the tape dispensers 20 mounted thereon. The adhesive areas preferably have a pull strength in the range of between about 6 ounces/square inch and 64 ounces/square inch which is sufficient to hold the tape dispensers 20 to display board 14 and to prevent accidental removal of the tape dispensers 20 from display board 14 but not so strong that a consumer needs to apply an extraordinary force to intentionally remove tape dispensers 20 from display board 14. The adhesive device may be a plurality of rows of adhesive strips affixed to the upper surface 36. The adhesive strips may be lengths of double-sided adhesive tape that are applied to display board 14 at predetermined intervals across the width of the display board 14. Alternatively, the adhesive areas may be an acrylic or rubber based glue that is extruded onto the upper surface 36 of display board 14 during production. Alternatively, tape dispenser 20 may be held to display board 14 by any variety of attachment means, including hang hooks or buttons, which would be attached to the board and extend outwardly therefrom, and would extend through a hole formed in the top of tape dispenser 20 without departing from the spirit of the invention.

The S-hooks 16 are preferably injection molded or extruded from a plastic such as polyvinyl chloride or polypropylene, though they may be fabricated from metal such as stainless steel, spring steel, or similarly resilient material. The S-hooks 16 include a flat middle section 60, a dependent upper hook 62 with an outwardly flared end 63, and a dependent lower hook 64 with an outwardly flared end 65. The S-hooks 16 are resiliently flexible and are preferably of an elongate lateral cross-section to firmly clip to and provide more contact area with the box 12 and the display board 14 such that display board 14 hangs evenly from upper rim 32 while inhibiting lateral swaying of display board 14 if inadvertently bumped by consumers.

Figure 10:
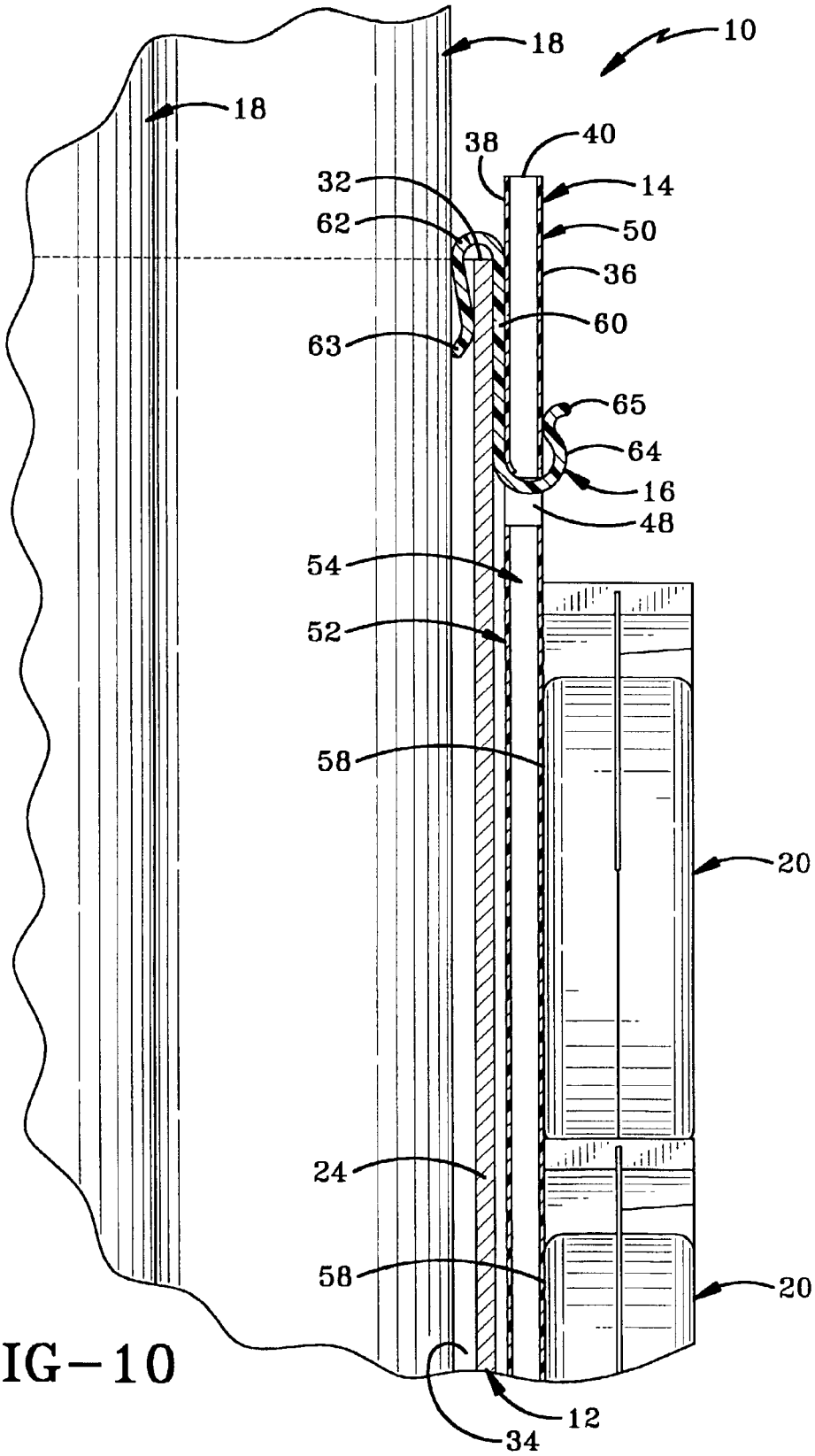
FIG. 10 is an enlarged fragmentary view of the box, display board, and tape dispensers taken along line 10—10 of FIG. 9.
Figure 11:
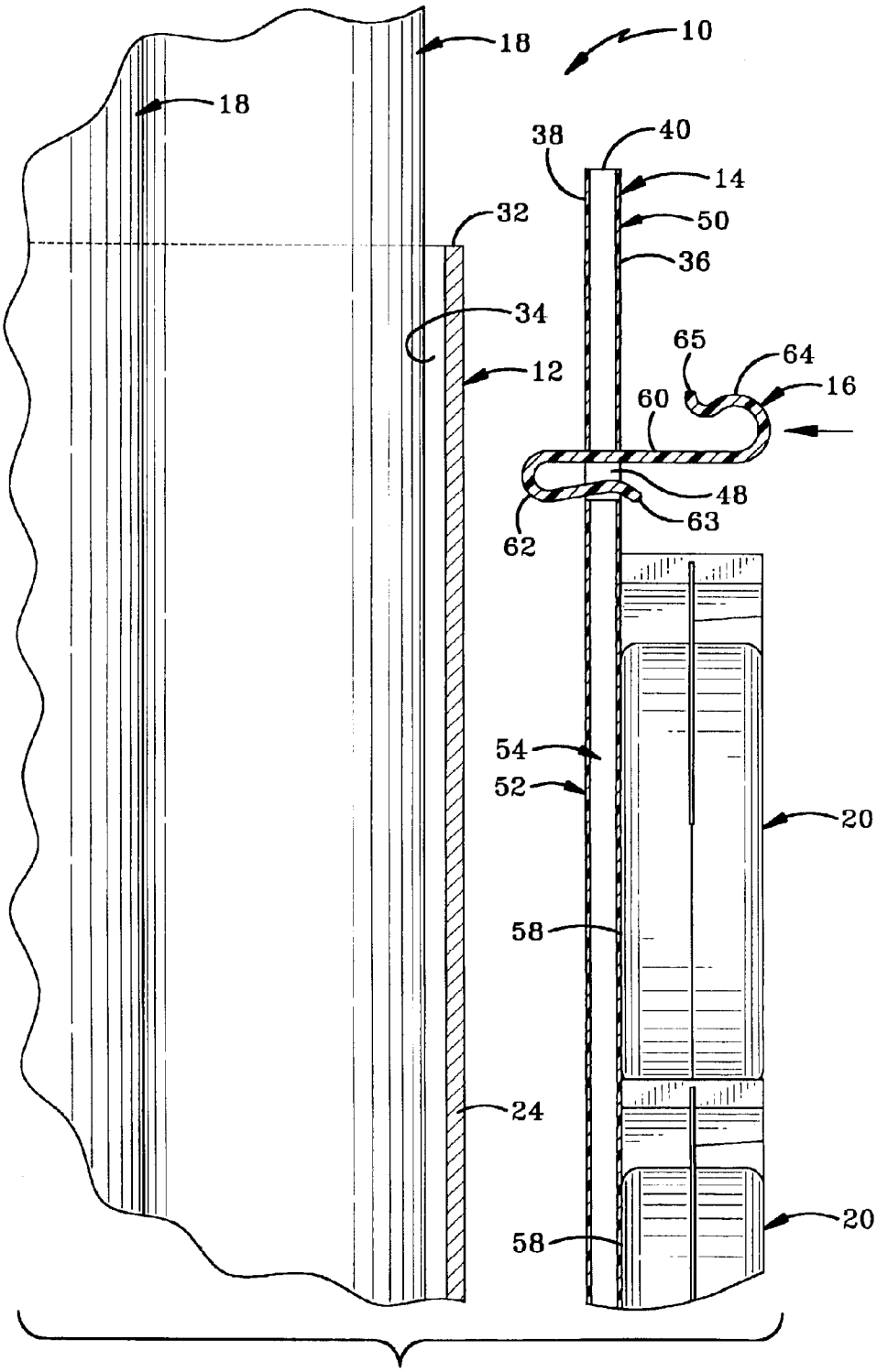
FIG. 11 is an enlarged fragmentary view of the box, display board, and tape dispensers corresponding to FIG. 10, but showing assembly of the S-hooks horizontally through mating hanging holes of the display board prior to assembly to the box.
Figure 12:
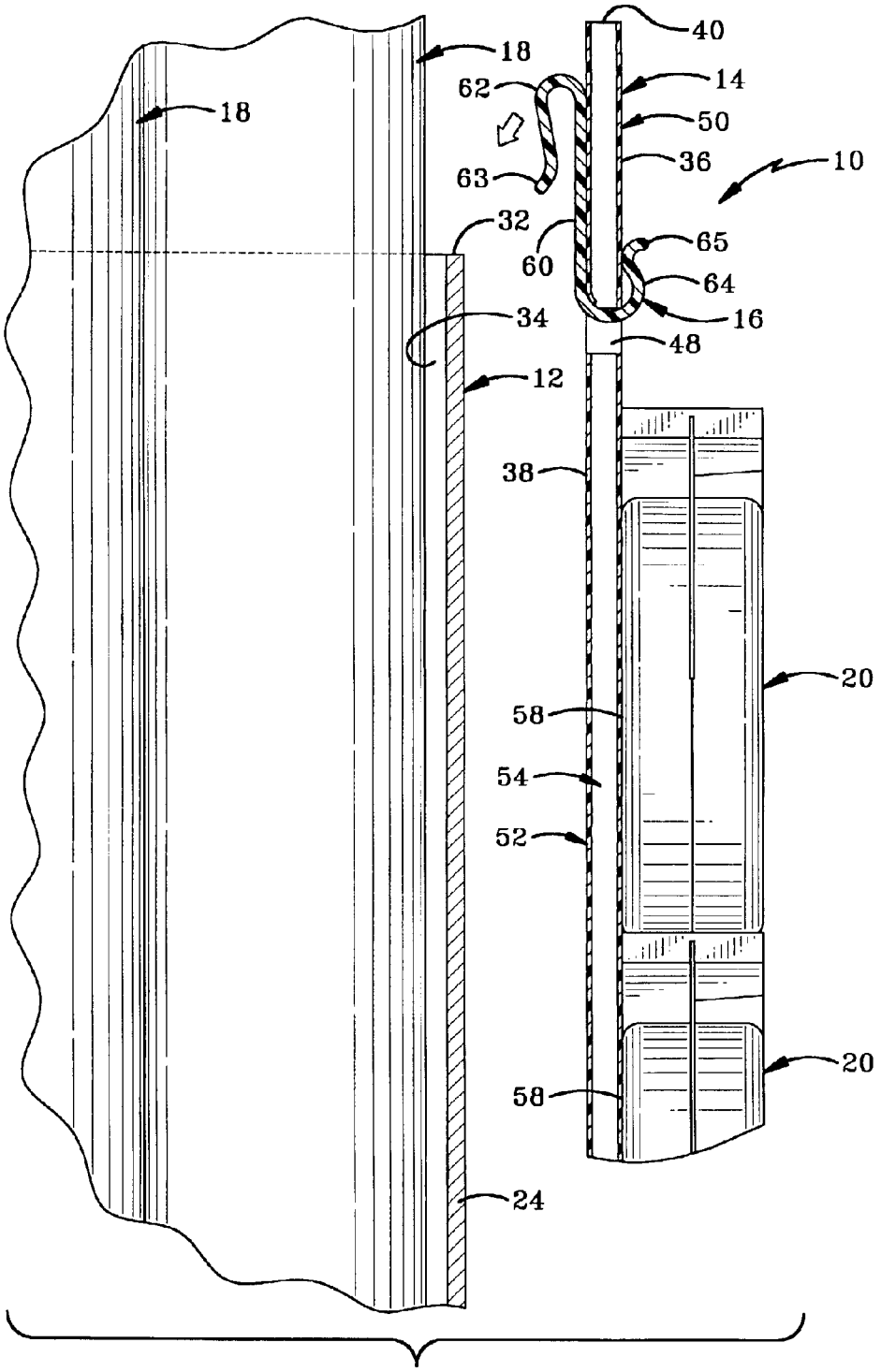
FIG. 12 is an enlarged fragmentary view of the box, display board, and tape dispensers corresponding to FIG. 11, but showing tilting of the S-hooks from the horizontal position to a vertical position for assembly to the box.
Figure 13:
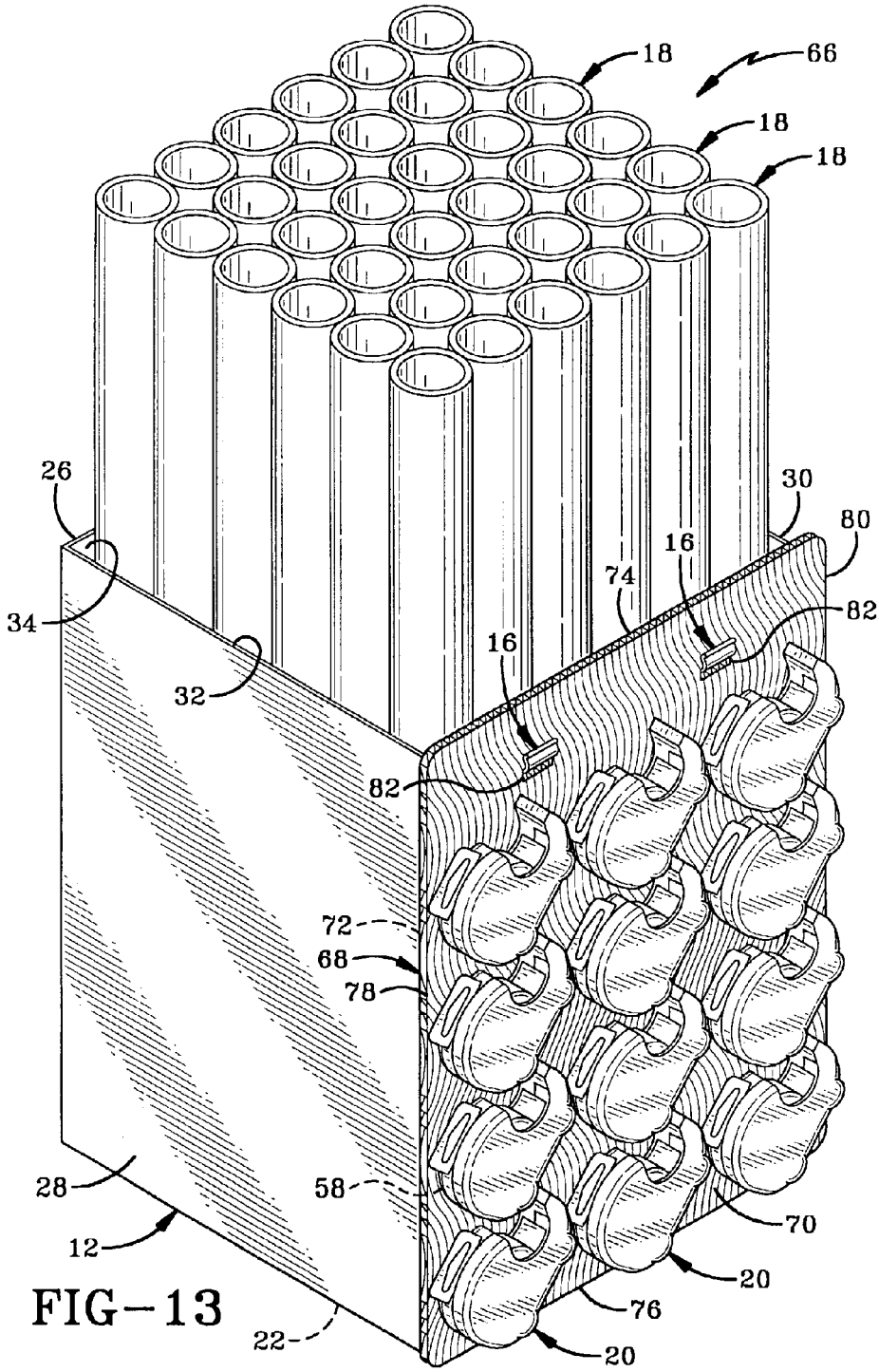
FIG. 13 is a perspective view of a second embodiment of the display of the present invention as used in a retail store for display to consumers, the display including the box and a second version display board attached to the upper rim thereof.
Figure 14:
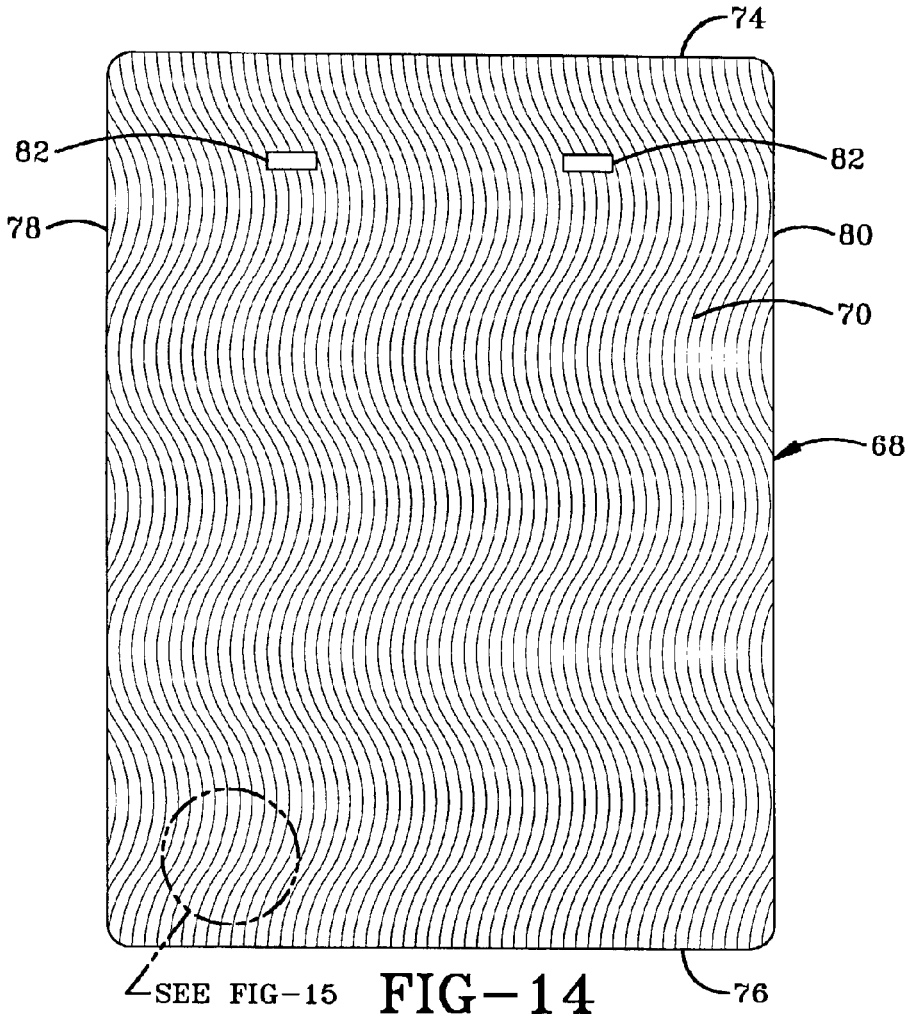
FIG. 14 is a front view of the display board shown in FIG. 13.
Figure 15:
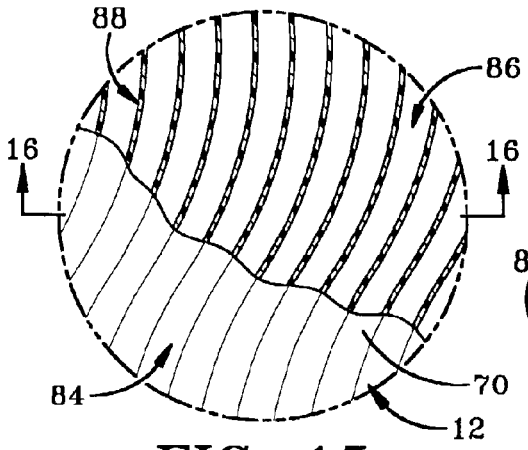
FIG. 15 is an enlarged fragmentary view of the display board taken along line 15—15 of FIG. 14, with a top sheet partially broken away showing a corrugated core comprised of a plurality of curved reinforcement ribs.
Figure 16:
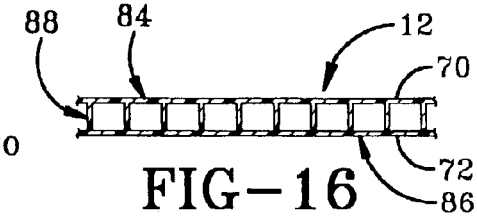
FIG. 16 is a sectional view of the display board taken along line 16—16 of FIG. 15.

Referring specifically to FIGS. 11–13, therein is shown how the S-hooks 16 are easily assembled to display board 14 which is then attached to box 12. The upper hook 62 is of a somewhat flattened shape in vertical cross-section, having a thickness which is about the same as the height of hanging holes 48 to permit close insertion of upper hook 62 therethrough with S-hook 16 in a horizontal position (FIG. 12). The lower hook 64 is of a more rounded shape in vertical cross-section, having a thickness greater than the height of hanging holes 48 so as to stop S-hooks 16 from passing completely through hanging holes 48 while in the horizontal position. When flared end 65 contacts the front surface 36 of display board 14, S-hook 16 is pivoted vertically upwardly about lower hook 64 to a vertical position with display board 14 securely retained between middle section 60 and flared end 65 (FIG. 10). Upper hooks 62 are then positioned with the middle section 60 and the flared end 63 gripping the upper rim 32 to support display board 14 in a substantially vertical position on box 12.

The tape dispensers 20 mounted to the display boards 14, as well as the other display boards disclosed herein with tape dispensers 20 or other retail products mountable thereto, are preferably shipped to retailers separate from the boxes 12 (including the top portion which is cut off to make box 12) in which the wrapping paper is shipped, comprising boxes of the type disclosed in my pending application "Shipping Box for Retail Products and Method of Assembling Same", filed Mar. 13, 2003 (serial number not yet available, the entire disclosure of which is herein incorporated by reference. The box disclosed therein is similar to box 12 in construction though obviously of a size to accommodate about one to three display boards 14 with retail products mounted thereto. The boxes, however, further include two flat rectangular top wall portions, two flat rectangular top inserts, and two flat rectangular end inserts which serve to immobilize the display boards and to firmly retain the retail products mounted to the display boards. This assures that the display boards are received by retailers with the retail products firmly mounted thereto.

A second embodiment of the improved display system of the present invention for use in a retail stores for displaying products to consumers is indicated at 66 in FIGS. 13–16. Display system 66 includes the box 12, a relatively rigid second version display board 68, and a pair of the S-hooks 16, shown as used with the plurality of paper rolls 18 and the plurality of single-roll tape dispensers 20 removably mounted on the display board 68.

Display board 68 includes an upper surface 70, a lower surface 72, respective upper and lower edges 74 and 76, and side edges 78 and 80. A pair of spaced hanging holes 82 of an elongate rectangular shape through display board 68 are disposed adjacent upper edge 74 through which the S-hooks 16 may be received for hanging display board 68 for displaying the tape dispensers 20. Display board 68 is preferably of corrugated construction, comprising a substantially flat front sheet 84 and a substantially flat rear sheet 86 interconnected by a second version, curved ribbed corrugated core 88 comprised of a plurality of parallel curved ribs which is bonded to each. The curved ribbed core 88 stiffens the display board 68 more than the straight ribbed core 54 to helping to prevent straight-line creasing when subjected to bending. Display board 68 is made of the same materials as display board 14. The tape dispensers 20 are removably mounted to the upper surface 70 of display board 68 using a plurality of adhesive areas (not shown) as described above which hold the tape dispensers 20 to display board 68 to prevent accidental removal of the tape dispensers 20 from display board 68 but not so strong that a consumer needs to apply an extraordinary force to intentionally remove tape dispensers 20 from display board 68.

Figure 17:
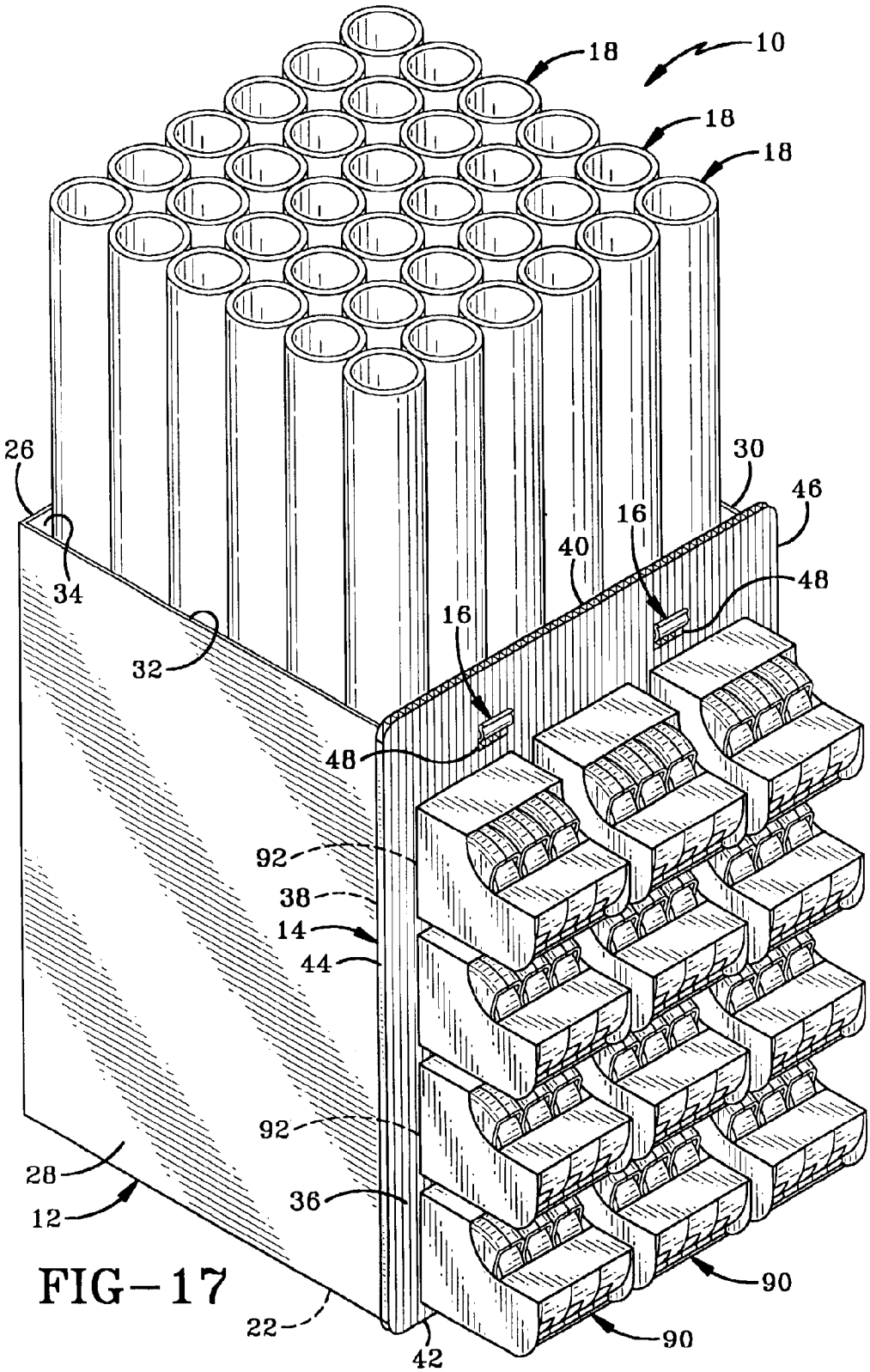
FIG. 17 is a perspective view of the display shown in FIG. 1, but shown with a plurality of tri-roll tape dispensers removably mounted to the display board.
Figure 18:
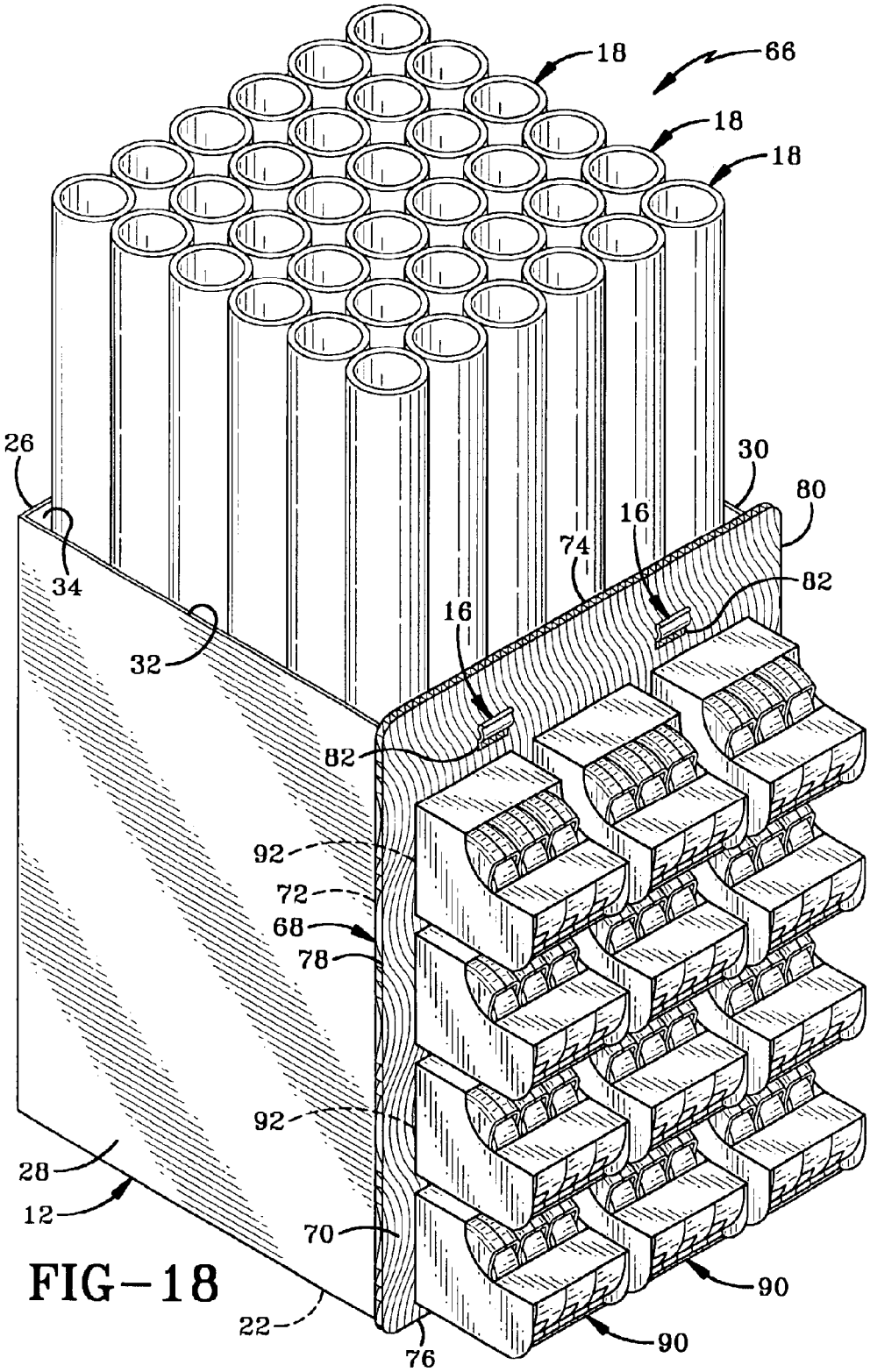
FIG. 18 is a perspective view of the display shown in FIG. 13, but shown with the plurality of tri-roll tape dispensers removably mounted to the second version display board.

The first and second embodiment improved display systems 10 and 66 are shown respectively in FIGS. 17 and 18 displaying the paper rolls 18 and alternate retail products in the form of a plurality of triple-roll tape dispenser packs 90 to retail consumers. Respective rear surfaces 92 of the tape dispenser packs 90 are removably mounted to the respective upper surface 36 of display board 14 and upper surface 70 of display board 68 using the pluralities of adhesive areas as described above.

The display boards 14 and 68 may also be of other constructions such as those disclosed in my pending application "Display Card for Merchandising Strips and Method of Manufacturing Same", U.S. patent application Ser. No. 10/209,434 filed on Jul. 30, 2002, the entire disclosure of which is herein incorporated by reference. One such other construction display board disclosed therein includes a first sheet comprising a display board of the types described above, and a second sheet of paper or cardboard of the same shape bonded to upper surface of the display board. The second sheet includes a plurality of product shaped holes therethrough configured to the shape of the retail product that will be attached to the display board during manufacture. The first sheet forms respective product-shaped backing areas to the product shaped holes of the first sheet aperture when the first and second sheets are bonded together. The adhesive used to join the sheets together may cover the entire front surface of the first sheet to secure the retail products thereto. The products may be reattached to the first sheet using adhesive which remains attached to the product following removal from the display board should the consumer decide not to purchase the product.

It is understood that many variations to the display system of the present invention may be made while staying within the same inventive concept. For example, the box and the display boards may be made of other substantially rigid and relatively rigid materials such as polyurethane foam which may be laminated with paper or plastic sheets, and the like. The complementary products may be mounted to the display board using devices other than adhesives which securely mount the complementary products to the display board while allowing easy dismounting and remounting. The box may be of other than a rectangular configuration, such as having a triangular, circular, or polygonal bottom wall. The upper rim may be other than parallel to the floor as shown, such as rounded, scalloped, and the like with appropriately positioned portions to accept the upper hooks.

Accordingly, the display system effectively displays primary products and complementary products in retail stores while not taking up valuable floor space, which may utilize the shipping box for the primary products as part of the display, to which the complementary products are removably mountable and remountable to permit closer inspection of products by consumers and remounting if the purchase decision is reversed, to which many different types of complementary products are mountable, which is of light weight, sturdy, inexpensive, may be disposable, may be biodegradable, and which solves problems and satisfies needs existing in the art, which achieves all the enumerated objectives, provides for eliminating difficulties encountered with prior art devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved display system is constructed and used, the characteristics of the construction, and the advantageous, new and useful results obtained; the new and useful structures, devices, elements, arrangements, parts and combinations, are set forth in the appended claims.

What is claimed is:

1. A display system for supporting a plurality of primary products and a plurality of complementary products on a floor of a retail store, comprising:

a box having a substantially rectangular bottom wall adapted to be supported on the floor, and an upwardly dependent peripheral wall comprising opposing front and rear walls and a pair of opposing side walls which terminates at an upper rim, said bottom and peripheral walls which define a product receiving interior chamber adapted to receive the plurality of primary products;

a display board which includes a first sheet made of a corrugated material having a corrugated core comprised of a plurality of parallel ribs sandwiched between respective substantially flat front and rear sheets having respective front and rear surfaces, a second sheet is bonded to said front surface, said second sheet having a plurality of complementary product receiving holes therethrough shaped to receive the complementary products therein, said front surface forming respective backing surfaces for said product receiving holes to removably mount the plurality of complementary products by having an adhesive applied to said backing surfaces which allows for repeated removal and replacement of the complementary products mounted thereon; and at least two retaining devices adapted to connect said display board to said peripheral wall in a generally vertical orientation, each comprising an S-hook having an upper hook adapted to engage said upper rim of said box and a lower hook adapted to engage the display board through a corresponding hanging hole through said display board spaced apart adjacent an upper edge thereof to hang said display board in a substantially vertical orientation from said upper rim of said box with the front surface of said display board facing away from said box to allow display of the primary products and the rear surface facing said box.

2. The display system as defined in claim 1 in which the S-hooks are of a laterally elongate rectangular cross-section, each of the upper and lower hooks having an outwardly-flared end, and the hanging holes being of an elongate rectangular shape adapted to receive said upper hook therethrough to facilitate assembly of said S-hooks to the display board.

3. The display system as defined in claim 1 in which the adhesive comprises double-sided tape applied to the front surface of the display board.

4. The display system as defined in claim 1 which the adhesive comprises a liquid adhesive that is applied to the front surface of the display board which at least partially dries.

5. The display system as defined in claim 1 in which the adhesive has a pull strength in the range of between about 6 ounces/square inch and 64 ounces/square inch.

6. The display system as defined in claim 1 in which the ribs are substantially straight.

7. The display system as defined in claim 1 in which the display board is made of plastic.

8. The display system as defined in claim 1 in which the product receiving holes are adapted to be configured in the shape of the products displayed on the display board.

9. The display system as defined in claim 1 in which the adhesive is applied to substantially cover the front surface of the backing area.

10. The display system as defined in claim 1 in which the adhesive is applied in distinct bands across the backing surface.

* * * * *